US007520028B2

(12) United States Patent
Borleis et al.

(10) Patent No.: US 7,520,028 B2
(45) Date of Patent: Apr. 21, 2009

(54) HINGE DEVICE

(75) Inventors: Daniel Borleis, Waltrop (DE); Juergen Hulbert, Eltville (DE); Jens Schenkenberger, Frankfurt (DE); Andreas Stern, Ehlscheid (DE)

(73) Assignee: GM Global Technology Operations, Inc., Detroit, MI (US)

( * ) Notice: Subject to any disclaimer, the term of this patent is extended or adjusted under 35 U.S.C. 154(b) by 463 days.

(21) Appl. No.: 10/562,092

(22) PCT Filed: Feb. 18, 2005

(86) PCT No.: PCT/EP2005/001661

§ 371 (c)(1),
(2), (4) Date: Dec. 21, 2005

(87) PCT Pub. No.: WO2005/083213

PCT Pub. Date: Sep. 9, 2005

(65) Prior Publication Data

US 2007/0096503 A1 May 3, 2007

(30) Foreign Application Priority Data

Feb. 19, 2004 (DE) ..... 10 2004 008 069

(51) Int. Cl.
*E05D 3/06* (2006.01)

(52) U.S. Cl. ..... 16/366; 16/368; 16/354

(58) Field of Classification Search ..... 16/366, 16/368–370, 280–282, 286–288; 296/146.11, 296/146.12; 49/246–248; 244/129.4, 129.5; 474/112, 141

See application file for complete search history.

(56) References Cited

U.S. PATENT DOCUMENTS

| | | | | | |
|---|---|---|---|---|---|
| 513,589 | A | * | 1/1894 | Metz | 474/141 |
| 530,058 | A | * | 11/1894 | Schaum et al. | 474/112 |
| 596,289 | A | * | 12/1897 | Smith | 474/141 |
| 2,378,634 | A | * | 6/1945 | Hussey | 280/260 |
| 3,016,261 | A | | 1/1962 | Tatter | 296/46 |
| 3,899,932 | A | * | 8/1975 | Durham | 474/141 |
| 4,181,034 | A | * | 1/1980 | Daniel | 474/141 |
| 4,607,812 | A | * | 8/1986 | De Haan et al. | 244/129.5 |
| 4,865,577 | A | * | 9/1989 | Freudenstein | 474/141 |
| 5,289,615 | A | * | 3/1994 | Banks et al. | 16/366 |
| 5,882,025 | A | * | 3/1999 | Runnels | 280/259 |

FOREIGN PATENT DOCUMENTS

| | | | |
|---|---|---|---|
| DE | 1 027 558 | | 4/1958 |
| DE | 1 174 183 | | 7/1964 |
| DE | 19827813 | A1 * | 12/1999 |
| FR | 2 731 461 | | 9/1996 |

OTHER PUBLICATIONS

U.S. Appl. No. 10/910,232, filed Aug. 3, 2004, Lang et al.

* cited by examiner

*Primary Examiner*—Chuck Y. Mah

(57) ABSTRACT

In the case of a hinge device with an arm and with two head pieces mounted to pivot/swivel on the ends of the arm around respectively one axis, the head pieces are respectively joined to revolve with one of the two belt pulleys, which are circumscribed by a common traction belt on one circumferential surface, and at least one of the belt pulleys is not circular but preferably elliptical.

18 Claims, 5 Drawing Sheets

HINGE DEVICE

TECHNICAL FIELD

The current invention concerns a hinge device, more specifically, but not necessarily, for the installation of a door on the body of a motor vehicle.

BACKGROUND OF THE INVENTION

So-called pantograph doors for buses have long been known. In them, a hinge device is formed by a pair of arms whose one end respectively attaches at the level of a body-mounted axis and whose other end attaches at the level of an axis connected to the door. The effective length of these two arms, that is to say, the spacing distance between their two axes, must be equal, and so must also the spacing distance between the two door side axes be equal, on the one hand, and the spacing distance between the two body-mounted axes on the other hand, so that the door maintains its orientation upon opening and closing and so that, in an open position, the door can hang next to the door opening and be parallel to said opening against the body.

The parallel movement of the door leads to the situation that, upon closing, such doors are engaged all at once by the totality of their edges into the frame of the door opening, so that if another window or door is not open on the vehicle body, a temporary buildup of excess pressure is generated on the interior of the motor vehicle by the inward movement of the door, said pressure slowing down the movement of the door and, in this manner, hindering the door locking mechanism from catching. Another problem consists therein that when the door is inadvertently opened while the vehicle is being driven, the relative wind—as opposed to the conventional case in which a door is mounted to the body by a single hinge on the front door edge, relative to the direction of travel—can bear down behind the partially-opened door and pry it completely wide open.

SUMMARY OF THE INVENTION

The object of the current invention is to create a hinge device for connecting a moving part with a stationary part in which, between the two mutually staggered yet oriented-in-parallel positions, the stationary part at least runs through a pivoted position relative to these parallel positions.

The task is resolved by a hinge device with the characteristics of claim 1.

When, in the case of the moving parts, we are dealing with a door as described above, these two parallel positions can correspond to a closed door position and to an open arrested door position in which said door rests offset alongside the body, in parallel to the closed position. By virtue of having to run through a pivoted position to get from the closed position to the open parallel position, the movement involved upon closing the door is not an exact parallel translational motion so that a pressure buildup on the interior of the motor vehicle is avoided and the door can fall unobstructed into the lock. With the proper orientation of the pivoted position in terms of the relative wind, the latter exerts a force upon the door that is in the direction of the closed door; an unexpected wide open prying of the door is thus excluded.

In order that between the two end positions of the hinge device head pieces in terms of the arm, two counter running traverse movements of the head pieces are obtained relative to one another, then in a first of these end positions the spacing distance of a first point of incidence, at which the traction belt impinges upon the first belt pulley, should be smaller from the axis of this first belt pulley than the spacing distance of a second point of incidence, at which the traction belt impinges upon the second belt pulley, from the axis of the second belt pulley, while in the second end position the spacing distance conditions should be the reverse. Thus, translational conditions are achieved that are respectively greater or smaller than one between the rotations of the head pieces relative to the arm in the various end positions.

Preferably, at least the one non-circular belt pulley is elliptical. The other belt pulley is preferably circular or also elliptical.

When both belt pulleys are elliptical, then they should be properly oriented in terms of one another so that a strong swiveling movement of the door can be achieved between the two end positions. For two ellipses of a given form and with the same circumferential length, the maximal swivel lift is attained when in one position of the first belt pulley in which the points of incidence of the belt at the first belt pulley are the points of intersection of the long axis with the circumference of the ellipse, the points of incidence at the other belt pulley respectively lie at the points of intersection of the short axis with the circumference.

In order to achieve a broad range of free swivel motion for the hinge device, it can be advantageous when the arm is angled and the traction belt between the belt pulleys is guided on two rollers.

BRIEF DESCRIPTION OF THE DRAWINGS

Additional characteristics and advantages of the invention emerge from the following description of exemplary embodiments while referencing the appended figures. The figures show.

DESCRIPTION OF THE PREFERRED EMBODIMENT

Figure 1:
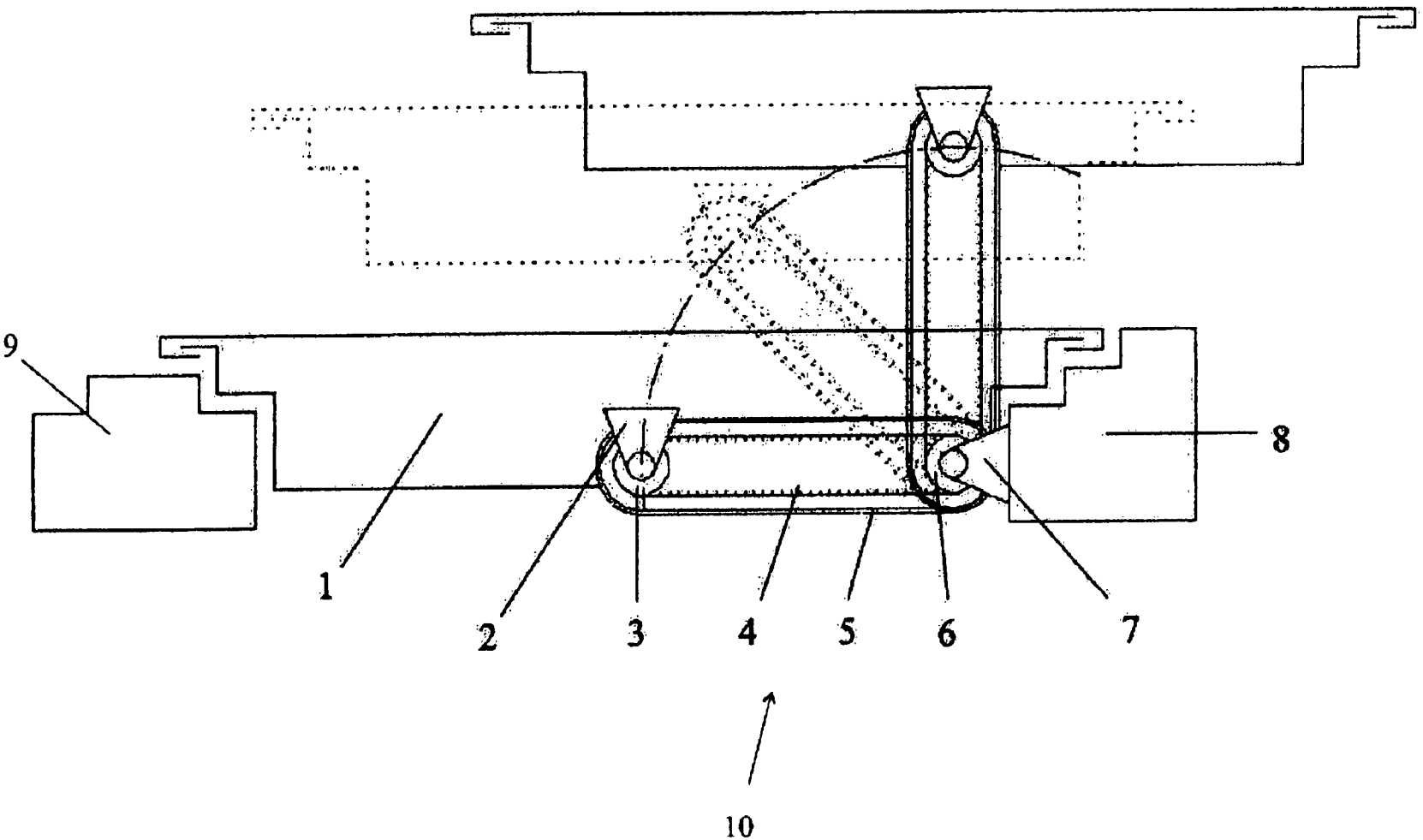
FIG. 1 a schematic section through a hinge device.

To clarify the principle of the invention and its effects, we shall first briefly explain the hinge device that is not in accordance with the invention as per FIG. 1. The figure shows a horizontal section through a door 1 of a motor vehicle and the posts 8, 9 of the body of a motor vehicle laterally surrounding the door 1. A hinge device generally designated by 10 comprises a first head piece 2 secured to the door 1 and a second head piece 7 secured to the right post 8 as well as an arm 5 to which the head pieces 2, 7 are joined to respectively pivot around an axis. The arm 5 is comprised by a hollow housing in the interior of which two belt pulleys 3, 6 are respectively connected in a twist-proof manner to the head pieces 2 or 7 through openings in the arm 5. An endless traction belt 4 is wrapped around the circumferential surfaces of the two belt pulleys 3, 6.

In the hinge device in FIG. 1, the belt pulleys 3, 6 are both circular and have the same diameter so that a rotation of the head piece 2 or 7 relative to the arm 5 is translated with the aid of the traction belt 4 in a rotation of equal degree by the respective other head piece 7 or 2. As a consequence, upon movement from a closed to an open position, the door 1 always maintains the same orientation between the posts 8, 9.

Figure 2:
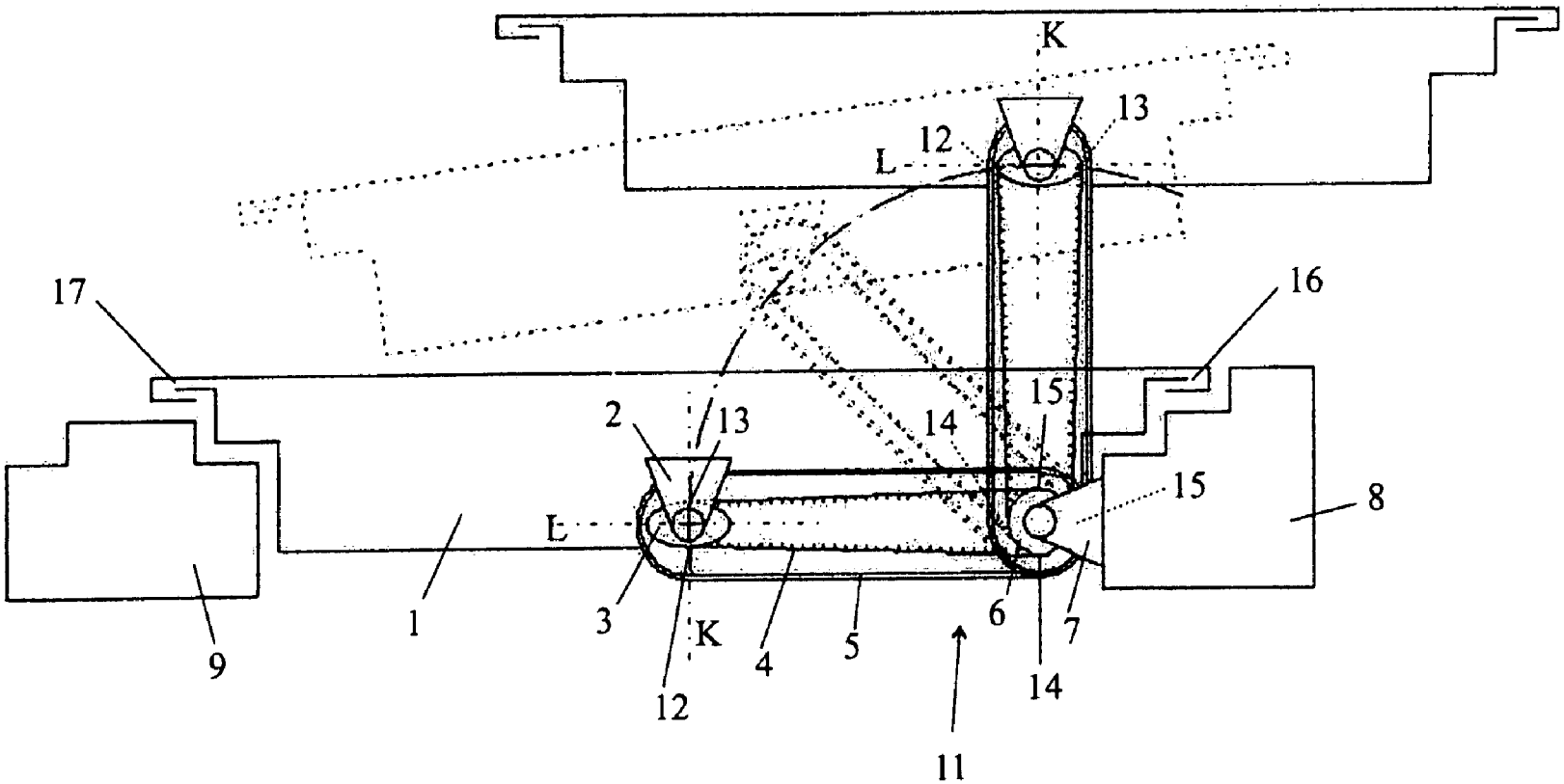
FIG. 2 a section analogous to that in FIG. 1 through a first form of embodiment of a hinge device in accordance with the invention.

The first form of embodiment of the hinge device 11 in accordance with the invention shown in FIG. 2 corresponds to that shown in FIG. 1 in all that was stated above with the exception of the form of the first belt pulley 3. In the form of embodiment shown in FIG. 2, said belt pulley has a non-circular, or more specifically stated, an elliptical profile. In the closed position of the door 1, between the posts 8, 9 lie the points of incidence 12, 13, at which the two strands of the traction belt 4 tangentially contact the belt pulley 3, essentially on a short axis of the ellipse designated by the dashed line K. (An exact position of the points of incidence on the short axis K would result if the strands of the traction belt 4 were to run parallel between the belt pulleys 3, 6; however, this deviation has been omitted in the context of the current description since it has no significance for the functioning mode of the hinge device in accordance with the invention.) The spacing distance of the points of incidence 12, 13 from the axis of the belt pulley 3, in the closed position of the door 1, is smaller than the spacing distance of the corresponding points of incidence 14, 15 from the axis of the circular belt pulley 6 of the head piece 7 secured to the post 8. The translational relation between the head piece 7 and the head piece 2 is therefore slightly greater than one in the closed position so that when the arm 5 pivots around the axis of the head piece 7 upon opening of the door, this pivoting movement is not only counteracted by the corresponding rotation of the head piece 2 in terms of the arm 5, but it is overcompensated. Upon opening the door, the edge 16 of the door adjacent to the post 8 moves faster away from the door opening than the edge 17 adjacent to the post 9, and the door 1 runs through an intermediate position, represented by the dashed line outline in FIG. 2, in which it is clearly swung in terms of its orientation in the closed position. Accordingly, upon closing of the door 1, first the edge 17 comes to rest up against the post 9 and then the edge 16 comes against the post 8 so that a buildup of pressure on the interior of the vehicle is avoided upon closing of the door.

Assuming that the direction of travel of the vehicle runs from right to left in the figure, the relative wind would hit obliquely on the outside of the partially-opened door represented in FIG. 2 as the dashed line outline. The door 1 would thus be pushed into its closed position by the relative wind if it had been opened while the vehicle was traveling. Thus, an unintended prying open of the door by the relative wind would be excluded during travel.

To the extent of the manner in which the arm 5 is swung, the points of incidence 12 through 15 of the traction belt 4 on the belt pulleys 3, 6 wander, whereby the spacing distance of the points of incidence 12, 13 from the rotational axis of the belt pulley 3 continuously increases, while the corresponding spacing distance for the points of incidence 14, 15 of the circular belt pulley 6 remains the same. The greater the spacing distance becomes at the belt pulley 3, the smaller the translational relation becomes so that the initial pivoting movement of the door in the counterclockwise direction over the course of opening becomes slower and slower and finally reverses its direction. In the open position of the door 1, once more represented by dashed lines, the points of incidence 12, 13 respectively lie at the point of intersection of a long axis L of the ellipse with the circumferential surface of the belt pulley 3, and the orientation of the door is the same as in the closed position.

The prerequisite condition for the orientational positions of the door to be the same in the open position as in the closed position consists therein that the path traveled by the points of incidence be the same on the two belt pulleys upon opening and closing. In the case represented here, of a freely-pivoting movement of 90° between the open and closed position, this corresponds to the requirement that the circumferential length of both belt pulleys 3, 6 must be the same. Based on the full scale enlargement or reduction of the belt pulley 3 relative to the belt pulley 6, one can however achieve the effect that with an angle of traverse of less than 90° or precisely with an angle of traverse of more than 90°, the door can once more assume an orientation that is parallel to its closed position.

While in FIG. 2, the belt pulley 3 on the door side is elliptical and the belt pulley 6 on the post side is circular, the same result could be achieved by using a circular belt pulley 3 on the side of the door 1 and an elliptical belt pulley 6 on the side of the post 8; however, with an orientation of the elliptical belt pulley rotated by 90° as compared to the orientation in FIG. 2, so that once more in the closed position of the door, the spacing distance of the points of incidence 14,15 of the traction belt on the belt pulley 6 is greater and in the open position, it is smaller than the spacing distance of the points of incidence 12, 13 on the belt pulley 3.

Figure 3:
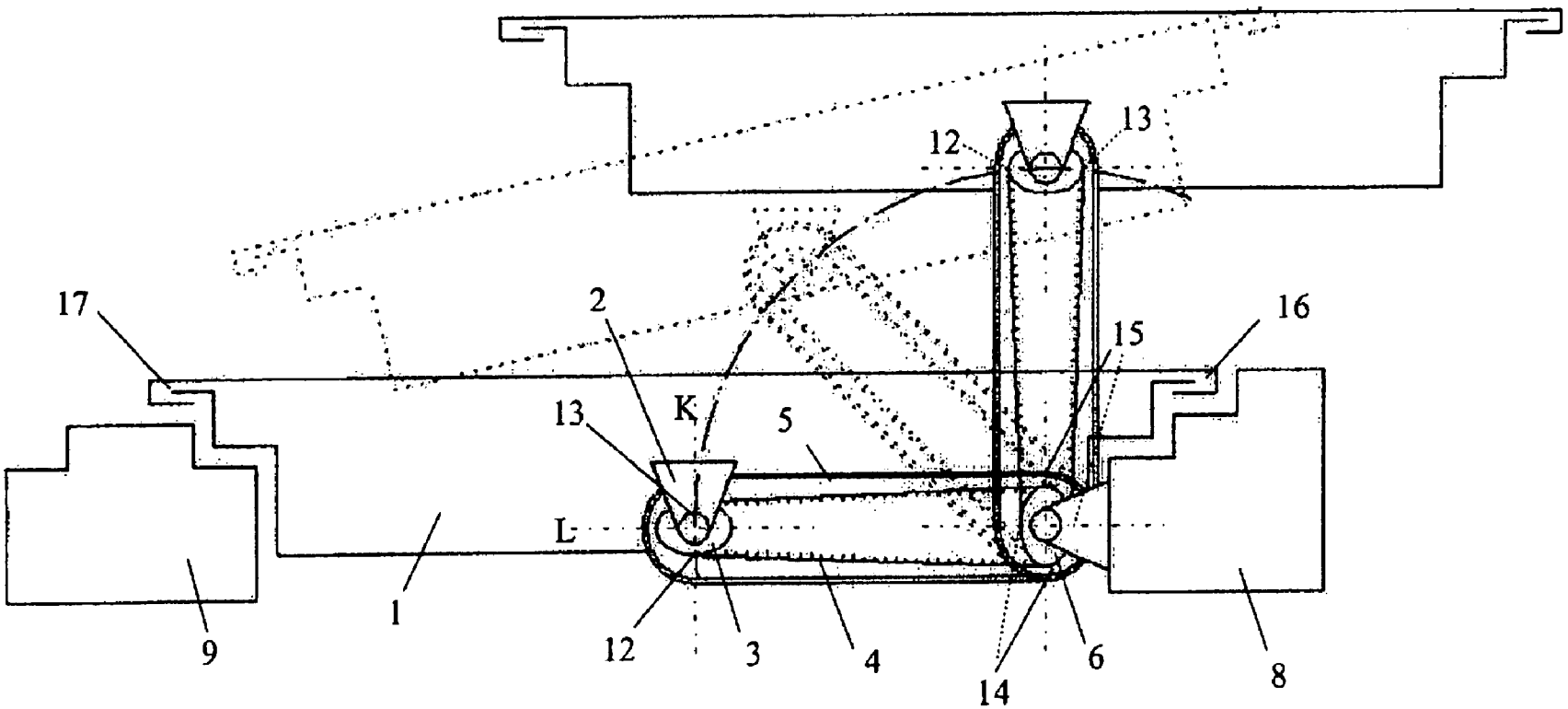
FIG. 3 a section analogous to that in FIG. 1 through a second form of embodiment of a hinge device in accordance with the invention.

An intensification of the swivel movement is achieved in that, as shown in the exemplary embodiment of FIG. 3, both belt pulleys 3, 6 are selected to be elliptical with the same dimensions, but with the long axes L that are oppositely rotated relative to one another. If the long axes L were not oppositely rotated, but rather parallel to one another, the door 1 would not swivel in its movement. A maximal swivel lift is achieved when the long axes L of the two ellipses are oriented to be perpendicular to one another.

Figure 4:
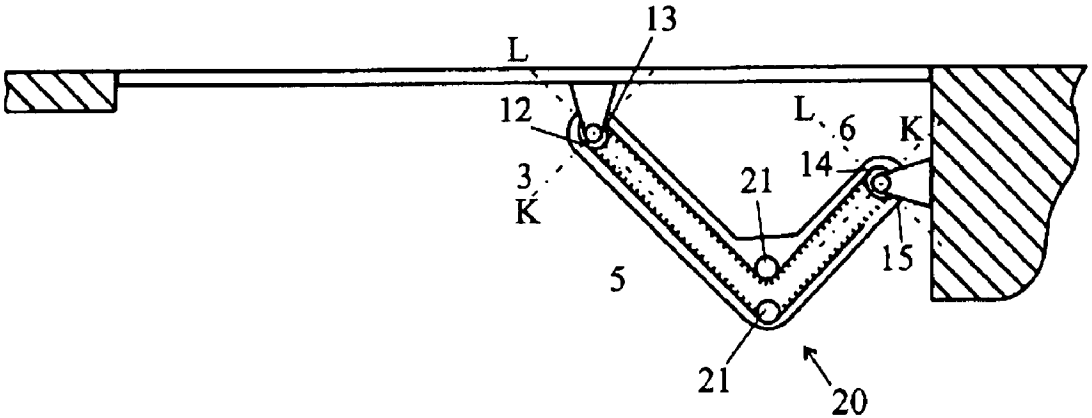
FIG. 4 a section through a third form of embodiment of the hinge device on the body of a motor vehicle with a closed door.
Figure 5:
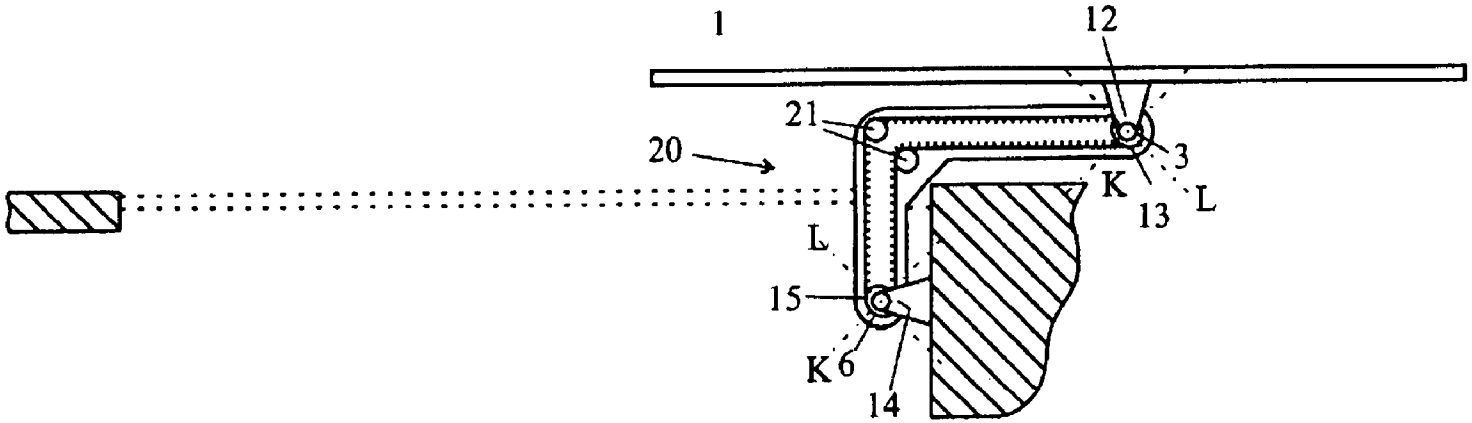
FIG. 5 a section through the third form of embodiment with the door opened up to the stop.

FIGS. 4 and 5 show a third form of embodiment of a hinge device in accordance with the invention that is on the door of a motor vehicle. Parts in these figures that are identical or that have the same function as those parts shown in FIGS. 1-3 bear the same reference number and shall not again be explained in detail. The hinge device 20 here, according to this third form of embodiment, distinguishes itself from those in FIGS. 2 and 3 by the angled form of its arm 5. The traction belt 4 on the inside of the arm is guided by two rollers 21 at an angle of 90°. The belt pulleys 3, 6 around which the traction belt 4 loops are both elliptical just as in the form of embodiment in FIG. 3. In the closed position in FIG. 4, the points of incidence 12, 13 of the belt on the belt pulley 3 are located at the intersecting points of their short axis K with the circumference, and the points of incidence 14, 15 of the belt pulley 6 are located at the intersecting points of the long axis L with the circumference. Based on this positioning, it is ensured that directly at the beginning of the opening movement of the door 1, the translational relation of the belt pulleys 3, 6 most pronouncedly deviates from 1 and then subsequently and continuously approaches 1 and finally becomes less than 1. Based on the angulation of the arm 5, the long axes L of both ellipses are parallel here.

As already explained in reference to FIG. 2, based on the spacing distances of the points of incidence 12 through 15 from the rotational axes of their belt pulleys 3, 6, the result is that the door 1 initially swings in the counterclockwise direction upon opening. Over the course of the opening movement, the swinging movement changes its direction to the extent that the points of incidence 12, 13 come closer to the intersecting point with the short axis K and to the extent the points of incidence 14, 15 come closer to the intersecting point with the long axis L. In this form of embodiment, a stop position which corresponds to the full opening of the door 1 is only attained at the end of a traverse movement of 135°, as shown in FIG. 5. In this position, the points of incidence 12, 13 on the belt pulley 3 have already moved past the intersecting points with the long axis and the points of incidence 14,15 on the belt pulley 6 have also moved past the intersecting points with the short axis. Nevertheless, the orientation of the door 1 in the open stop position is exactly parallel to the orientation in the closed position because the dimensions of the two belt pulleys 3, 6 have been selected to just slightly differ from one another.

Figure 7:
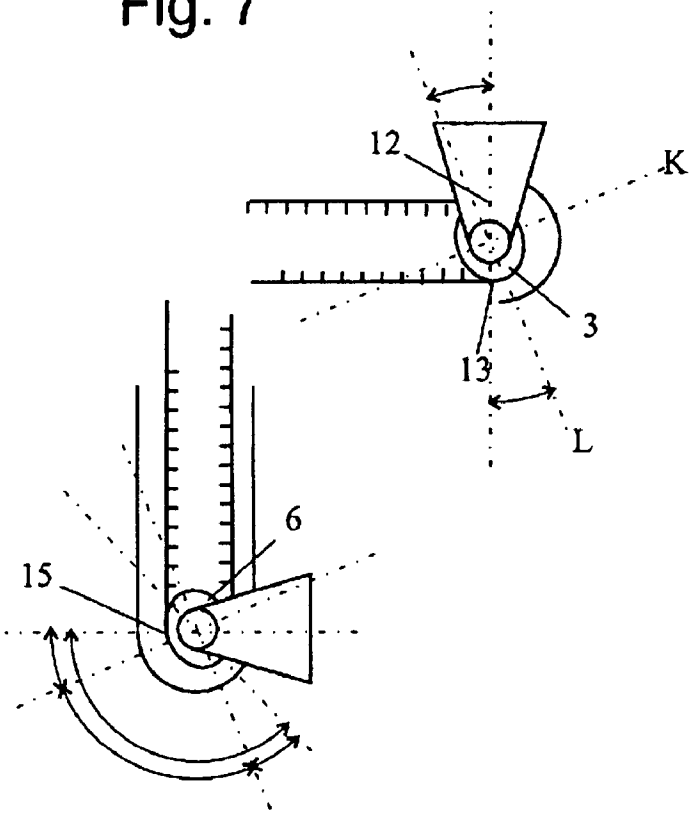
FIG. 7 the corresponding positions of the belt with the door open.
Figure 6:
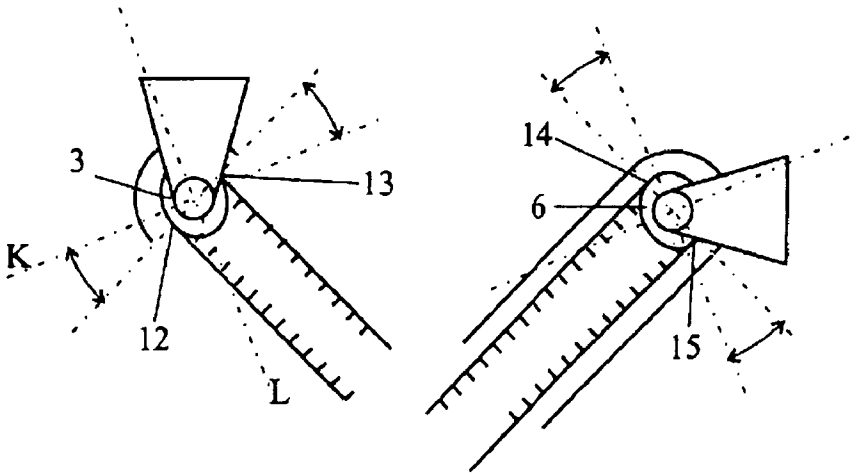
FIG. 6 the position of the belt on the belt pulley with the door closed in accordance with a variation of the third form of embodiment.

Another possibility for ensuring parallel orientational positions of the door in the closed state and in the open stop state with two identical belt pulleys 3, 6 is represented in FIGS. 6 and 7, whereby here, for the sake of obtaining an overview, the arm 5 has only been partially drawn in and the belt pulleys 3, 6 have been enlarged in their representation. If V is the angle of traverse between the closed and the opened position of the door, and the arm 5 is angled off by an angle G of 90° here, then the points of incidence 11 through 15 in the closed and opened position are respectively angularly displaced, in the manner shown, by an angle of 2=(∀−Q)/2 toward an intersecting point of the long and/or short axis L, K with the circumference of the belt pulley.

The invention claimed is:

1. A hinge device for mounting a vehicle door for movement between an open position and a closed flush position in a door opening having a front post at the front of the door and a rear post at the rear of the door; said hinge device comprising:

an arm having a front end and a rear end, a rear head piece fixedly attached to the rear post and pivotally mounted on a rear pivot axis at the rear end of the arm, a front head piece fixedly attached to the door and pivotally mounted on a front pivot axis at the front end of the arm, a rear pulley fixed on the rear head piece and having a circumference extending about the rear pivot axis, a front pulley fixed on the front end of the arm and having a circumference extending about the front pivot axis, a traction belt extending between and circumscribing the front and rear pulleys so that upon outward swinging movement of the door outwardly from a closed position flush with the door posts the traction belt is effective to couple the front head piece with the rear head piece and establish the angle of the door in relation to the door opening;

and at least one of the front and rear pulleys being non-circular whereby upon the outward swinging movement of the door the door from the closed flush position, the door is angled in relation to the door opening by initially moving the rear of the door away from the rear post at a rate faster than the moving of the front of the door away from the front post and then subsequently the rear of the door is moved away from the rear post a rate slower rate than the moving of the front of door from the front post until the door reaches an open position in which the door is parallel with the door opening.

2. The hinge device according to claim 1, wherein the spacing distance of a first point of incidence, at which the traction belt meets with one of the front and rear pulley is smaller than the spacing distance of a second point of incidence, at which the traction belt meets with the other of the front and rear pulley.

3. The hinge device according to claim 2, wherein the arm is angled and the traction belt is guided between the belt pulleys by two rollers.

4. The hinge device according to claim 2, wherein one of the belt pulleys is circular.

5. The hinge device according to claim 2, wherein the non-circular belt pulley is elliptical.

6. The hinge device according to claim 1, wherein the non-circular belt pulley is elliptical.

7. The hinge device according to claim 6, wherein the arm is angled and the traction belt is guided between the belt pulleys by two rollers.

8. The hinge device according to claim 6, wherein one of the belt pulleys is circular.

9. The hinge device according to claim 1, wherein one of the belt pulleys is circular.

10. The hinge device according to claim 9, wherein both belt pulleys have the same circumferential length.

11. The hinge device according to claim 9, wherein the arm is angled and the traction belt is guided between the belt pulleys by two rollers.

12. The hinge device according to claim 1, wherein both belt pulleys are elliptical.

13. The hinge device according to claim 12, wherein both belt pulleys have the same circumferential length.

14. The hinge device according to claim 13, wherein in the closed flush position of the door the position of the rear belt pulley is that the points of incidence of the traction belt on the rear belt pulley are the points of intersection of the long axis of the ellipse with the circumference of the ellipse of the rear pulley, and the points of incidence of the traction belt on the front belt pulley lie on the points of intersection of the short axis with the circumference of the front pulley.

15. The hinge device according to claim 12, wherein the arm is angled and the traction belt is guided between the belt pulleys by two rollers.

16. The hinge device according to claim 13, wherein the arm is angled and the traction belt is guided between the belt pulleys by two rollers.

17. The hinge device according to claim 1, wherein the arm is angled and the traction belt is guided between the belt pulleys by two rollers.

18. A hinge device for mounting a vehicle door for movement between an open position and a closed flush position in a door opening having a front post at the front of the door and a rear post at the rear of the door; said hinge device comprising an arm having a front end and a rear end, a rear head piece fixedly attached to the rear post and pivotally mounted on a rear pivot axis at the rear end of the arm, a front head piece fixedly attached to the door and pivotally mounted on a front pivot axis at the front end of the arm, a rear pulley of elliptical shape fixed on the rear head piece and having a circumference extending about the rear pivot axis, a front pulley of elliptical shape fixed on the front end of the arm and having a circumference extending about the front pivot axis, a traction belt extending between and circumscribing the front and rear pulleys so that upon outward swinging movement of the door outwardly from a closed position flush with the door posts the traction belt is effective to couple the front head piece with the rear head piece and establish the angle of the door in relation to the door opening;

and in the closed flush position the point of incidence of the traction belt with the rear pulley is at the intersection of the long axis of the ellipse with the circumference of the ellipse and the point of incidence of the traction belt with the front pulley is at the intersection of the short axis of the ellipse with the circumference of the ellipse so that upon the outward swinging movement of the door from the closed flush position, the door becomes angled in relation to the door opening by initially moving the rear of the door away from the rear post at a rate faster than the moving of the front of the door away from the front post, and then subsequently the rear of the door is moved away from the rear post a rate slower rate than the moving of the front of the door away from the front post until the door reaches an open position in which the door is parallel with the door opening.

* * * * *